US010125785B2

(12) United States Patent
Wilber et al.

(10) Patent No.: US 10,125,785 B2
(45) Date of Patent: Nov. 13, 2018

(54) REDUCED STRESS ROTOR INTERFACE

(71) Applicant: United Technologies Corporation, Hartford, CT (US)

(72) Inventors: John E. Wilber, East Hampton, CT (US); Bernard J. Reilly, Coventry, CT (US); Jeffrey M. Palitsch, East Hampton, MA (US); Rimal Patel, Windsor, CT (US); Jesse T. Carmichael, Vernon, CT (US); Ryan H. Quinn, Manchester, CT (US)

(73) Assignee: PRATT & WHITNEY, East Hartford, CT (US)

( * ) Notice: Subject to any disclaimer, the term of this patent is extended or adjusted under 35 U.S.C. 154(b) by 308 days.

(21) Appl. No.: 14/885,373

(22) Filed: Oct. 16, 2015

(65) Prior Publication Data

US 2017/0107998 A1 Apr. 20, 2017

(51) Int. Cl.

| | |
|---|---|
| ***F01D 5/02*** | (2006.01) |
| ***F04D 29/32*** | (2006.01) |
| ***F04D 29/08*** | (2006.01) |
| *F01D 5/06* | (2006.01) |

(52) U.S. Cl.

CPC ..... *F04D 29/321* (2013.01); *F01D 5/066* (2013.01); *F04D 29/083* (2013.01); *F01D 5/02* (2013.01); *F01D 5/025* (2013.01); *F01D 5/026* (2013.01); *F01D 5/06* (2013.01); *F05D 2230/642* (2013.01); *F05D 2260/941* (2013.01)

(58) Field of Classification Search

CPC ... F01D 5/02; F01D 5/066; F01D 5/06; F01D 5/026; F01D 5/025; F01D 5/243

USPC ..... 403/375, 28

See application file for complete search history.

(56) References Cited

U.S. PATENT DOCUMENTS

| | | | | |
|---|---|---|---|---|
| 6,106,188 | A | 8/2000 | Krautzig et al. | |
| 6,126,357 | A | 10/2000 | Alkelin et al. | |
| 7,470,113 | B2 * | 12/2008 | Tran | F01D 11/001 277/412 |
| 8,162,615 | B2 * | 4/2012 | Maalouf | F01D 5/3069 416/214 A |
| 8,459,943 | B2 * | 6/2013 | Schutte | F01D 5/066 415/199.4 |

(Continued)

FOREIGN PATENT DOCUMENTS

| | | | |
|---|---|---|---|
| DE | 102006037571 A1 * | 2/2008 | F01D 5/066 |
| WO | 2014028157 | 2/2014 | |

OTHER PUBLICATIONS

DE 102006037571—Original and translation from Espacenet.*
Extended European Search Report dated Jun. 6, 2017 in European Application No. 16192421.2.

*Primary Examiner* — Jason Shanske
*Assistant Examiner* — Behnoush Haghighian
(74) *Attorney, Agent, or Firm* — Snell & Wilmer L.L.P.

(57) ABSTRACT

A bladed rotor and a hub rotor for a gas turbine are provided. A bladed rotor may comprise a rotor interface comprising a radially inward surface, wherein the rotor interface comprises a constant diameter zone; and a reduced stress zone located adjacent to and aft of the constant diameter zone. A hub rotor may comprise a hub interface comprising a radially outward surface, wherein the hub interface comprises, a constant diameter zone, and a reduced stress zone located adjacent to and aft of the constant diameter zone.

7 Claims, 12 Drawing Sheets

(56) References Cited

U.S. PATENT DOCUMENTS

| | | | | |
|---|---|---|---|---|
| 8,727,695 | B2 * | 5/2014 | Caswell | F01D 5/082 415/1 |
| 9,169,730 | B2 * | 10/2015 | Barnett | F01D 5/14 |
| 2010/0239424 | A1 | 9/2010 | Maalouf et al. | |
| 2013/0121834 | A1 | 5/2013 | Barnett | |
| 2014/0064946 | A1 * | 3/2014 | Nielsen | F01D 5/06 415/199.5 |

* cited by examiner

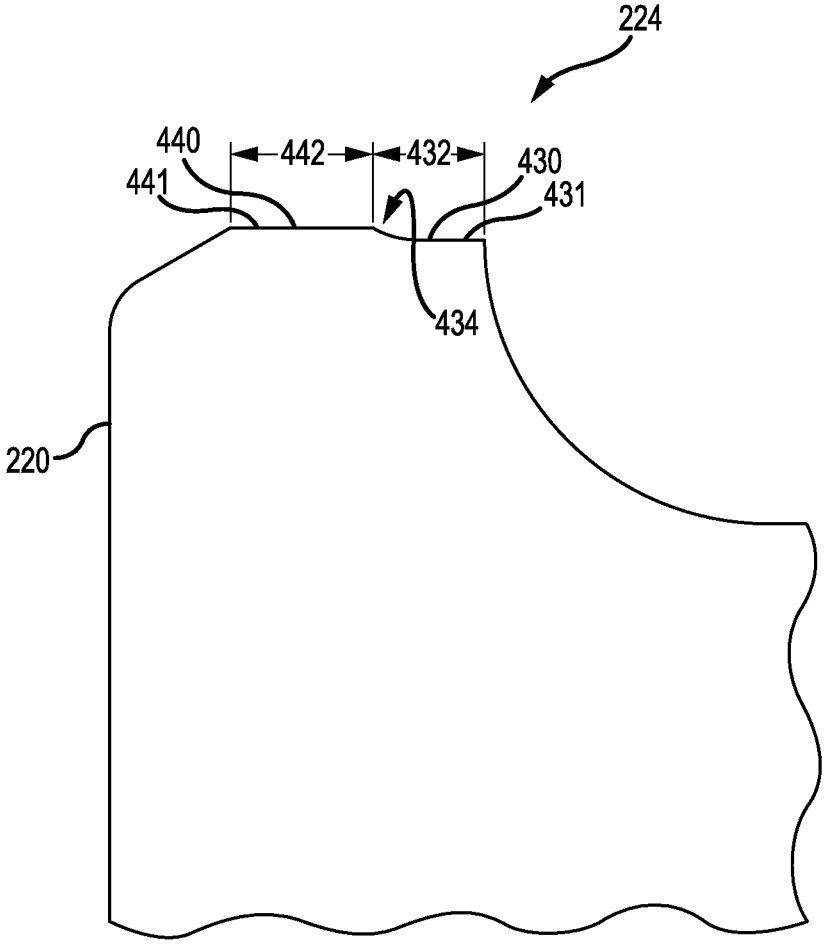
FIG.4B
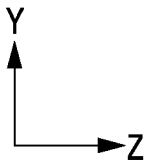

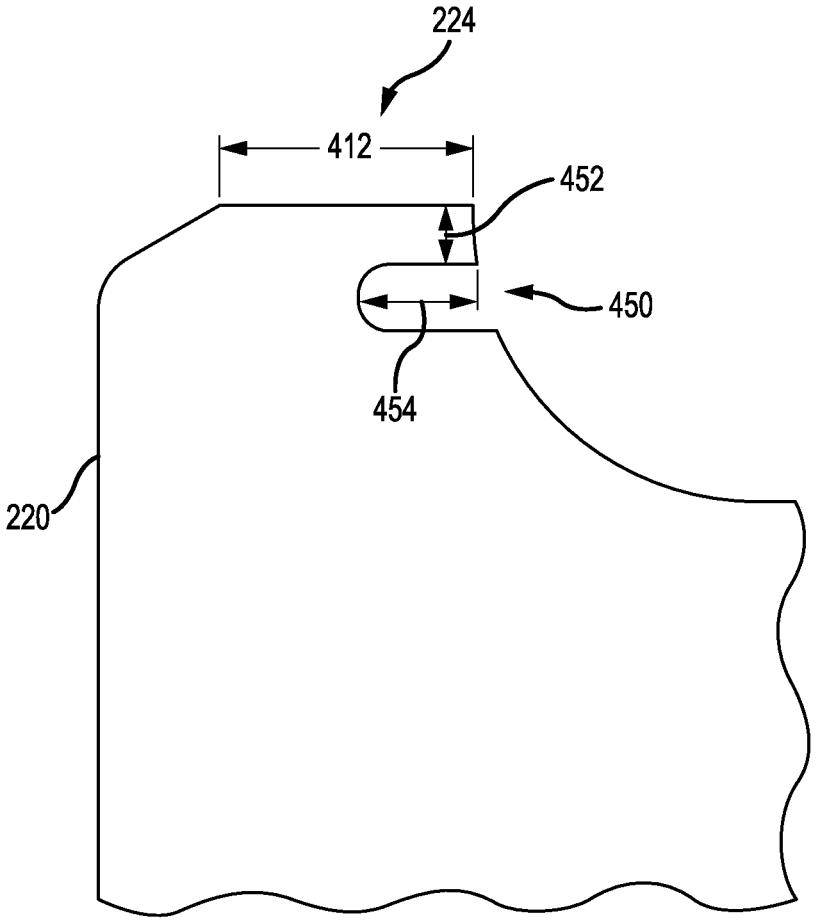
FIG.4C
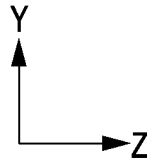

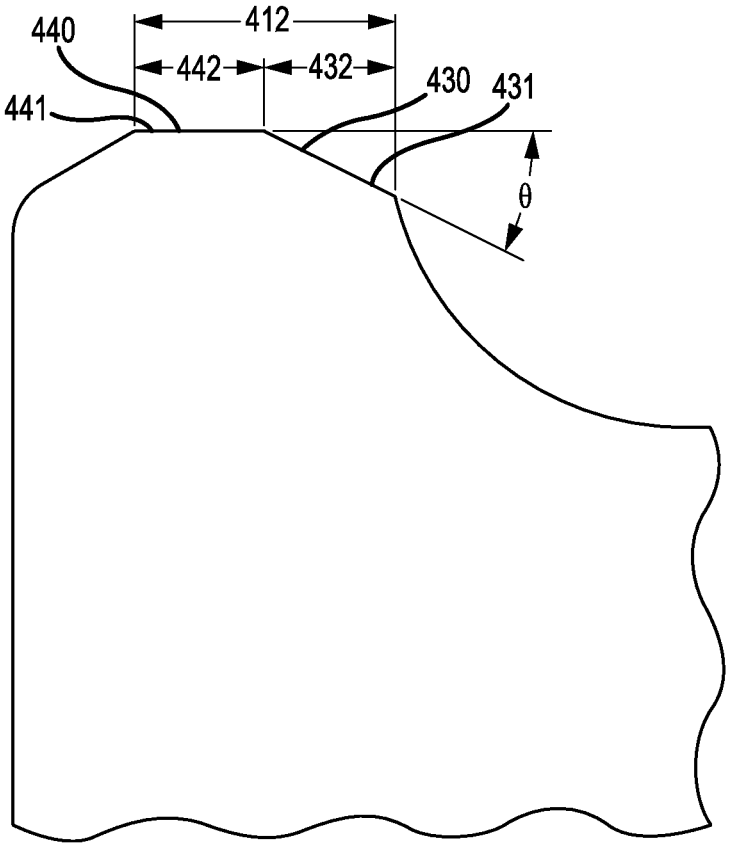
FIG.4E
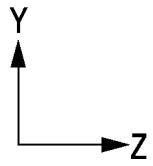

REDUCED STRESS ROTOR INTERFACE

FIELD

The present disclosure relates to gas turbine engines, and, more specifically, to a system and method that compensates for local stresses at an interface between two components.

BACKGROUND

A gas turbine engine may include a bladed rotor assembly. Bladed rotor assemblies may experience high temperatures which may cause thermal expansion and/or low-cycle fatigue. Components that do not have room for growth during thermal expansion may experience high stress and compressive forces.

SUMMARY

A bladed rotor for a gas turbine engine may comprise a rotor interface comprising a radially inward surface, wherein the rotor interface comprises, a constant diameter zone, and a reduced stress zone located adjacent to and aft of the constant diameter zone.

In various embodiments, a diameter along a width of the constant diameter zone may be constant. A surface of the reduced stress zone may comprise an angle with respect to a surface of the constant diameter zone. The angle may be between 1° and 89°. The angle may be between 10° and 50°. The bladed rotor may comprise a relief zone located radially outward from the rotor interface, wherein the relief zone may comprise at least one of a concave surface, slot, pocket, extrude cut, and trench. A width of the reduced stress zone may be between about 1% and 99% of a width of the rotor interface. A width of the reduced stress zone may be between about 5% and 50% of a width of the rotor interface.

A hub rotor for a gas turbine engine may comprise a hub interface comprising a radially outward surface, wherein the hub interface comprises a constant diameter zone and a reduced stress zone located adjacent to and aft of the constant diameter zone.

In various embodiments, a diameter along a width of the constant diameter zone may be constant. A surface of the reduced stress zone may comprise an angle with respect to a surface of the constant diameter zone. The angle may be between 1° and 89°. The angle may be between 10° and 50°. The bladed rotor may comprise a relief zone located radially outward from the hub interface, wherein the relief zone may comprise at least one of a concave surface, slot, pocket, extrude cut, and trench. A width of the reduced stress zone may be between about 1% and 99% of a width of the hub interface. A width of the reduced stress zone may be between about 5% and 50% of a width of the hub interface.

A bladed rotor assembly for a gas turbine engine may comprise a bladed rotor comprising a rotor interface comprising a radially inward surface, wherein the radially inward surface may comprise a first reduced stress zone, and a hub rotor comprising a hub interface comprising a radially outward surface, wherein the radially outward surface may comprise a second reduced stress zone.

In various embodiments, the radially inward surface may further comprise a constant diameter zone, wherein a diameter along a width of the constant diameter zone may be constant. A surface of at least one of the first reduced stress zone and the second reduced stress zone may comprise an angle with respect to a surface of a constant diameter zone. The angle may be between 1° and 89°. The bladed rotor assembly may comprise a relief zone located at least one of radially outward from the rotor interface and radially inward of the hub interface, wherein the relief zone may comprise at least one of a concave surface, slot, pocket, extrude cut, and trench. A width of at least one of the first reduced stress zone and the second reduced stress zone may be between about 5% and 50% of a width of the rotor interface.

The foregoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

FIG. 4B illustrates a schematic view of a hub rotor with a reduced stress zone, in accordance with various embodiments;

FIG. 4C illustrates a schematic view of a hub rotor with a relief zone, in accordance with various embodiments;

FIG. 4E illustrates a schematic view of a hub rotor with a reduced stress zone, in accordance with various embodiments.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical changes and adaptations in design and construction may be made in accordance with this invention and the teachings herein. Thus, the detailed description herein is presented for purposes of illustration only and not of limitation. The scope of the invention is defined by the appended claims. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials. In some cases, reference coordinates may be specific to each figure.

In various embodiments, a hub rotor may contact a bladed rotor at an interface. The interface between the bladed rotor and the hub rotor may be configured to mitigate factors such as, for example, low cycle fatigue and compressive stress. Low cycle fatigue may be a factor of engine thermal cycles (e.g., heating and cooling of an engine).

Figure 1:
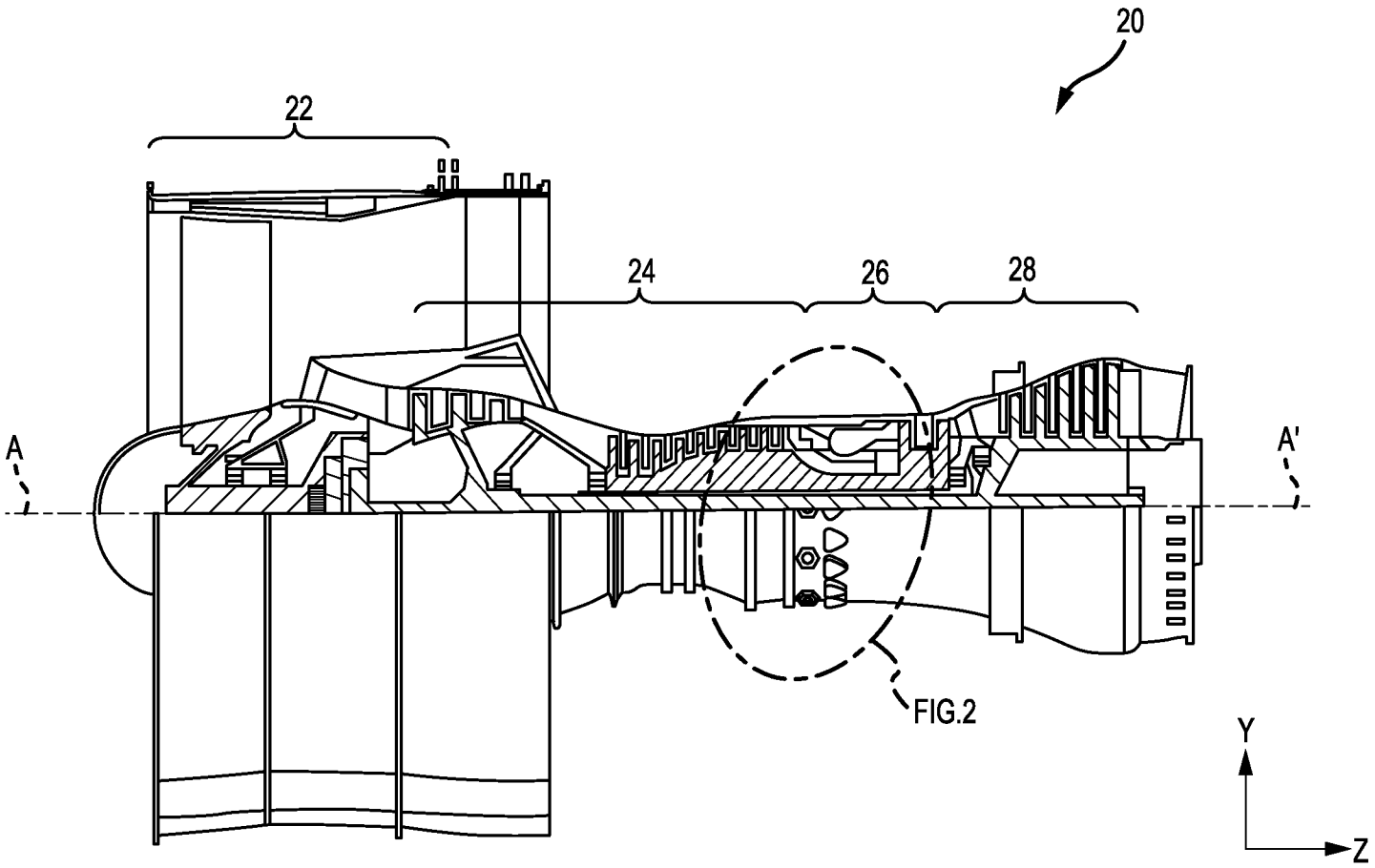
FIG. 1 illustrates a schematic view of a gas turbine engine, in accordance with various embodiments.

In various embodiments and with reference to FIG. 1, a gas turbine engine 20 is provided. Gas turbine engine 20 may be a two-spool turbofan that generally incorporates a fan section 22, a compressor section 24, a combustor section 26 and a turbine section 28. Alternative engines may include, for example, an augmenter section among other systems or features. In operation, fan section 22 can drive air along a bypass flow-path while compressor section 24 can drive air for compression and communication into combustor section 26 then expansion through turbine section 28. Gas turbine engine may comprise center axis A-A'. Although depicted as a two-spool turbofan gas turbine engine 20 herein, it should be understood that the concepts described herein are not limited to use with turbofans as the teachings may be applied to other types of gas turbine engines including three-spool architectures.

Figure 2:
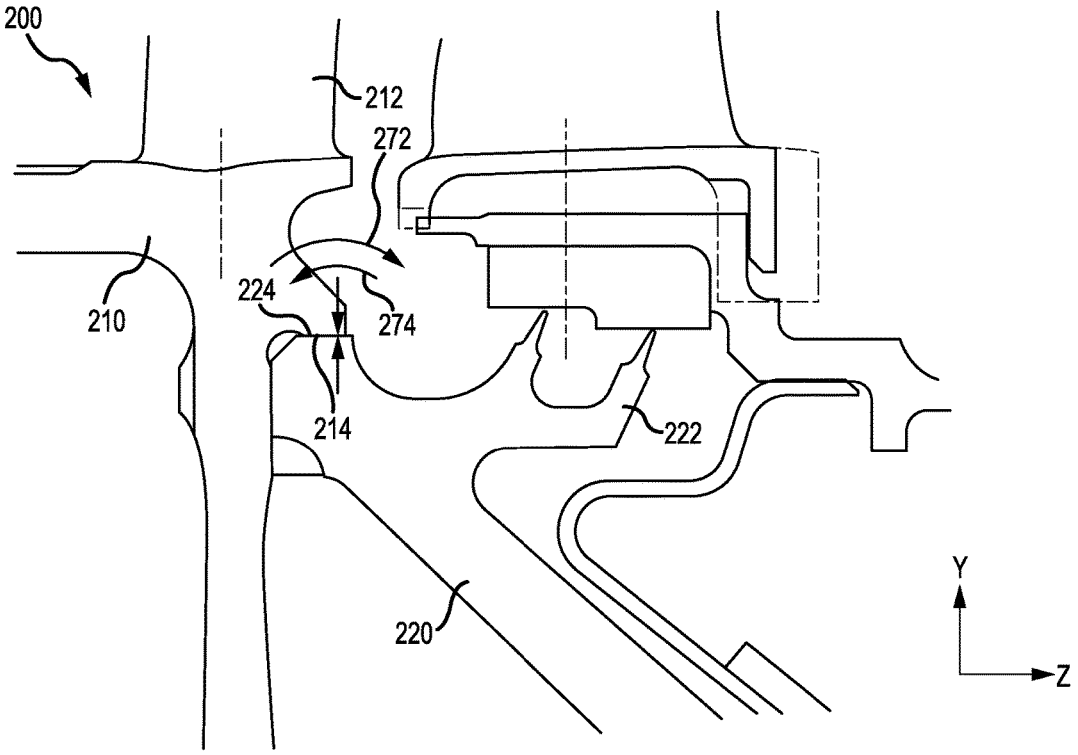
FIG. 2 illustrates a schematic view of a bladed rotor assembly, in accordance with various embodiments.

With respect to FIG. 2, elements with like element numbering as depicted in FIG. 1 are intended to be the same and will not necessarily be repeated for the sake of clarity.

With reference to FIG. 2, a bladed rotor assembly 200 is illustrated in accordance with various embodiments. A yz-axis is provided for ease of illustration. In various embodiments, bladed rotor assembly 200 may include bladed rotor 210 and hub rotor 220. Bladed rotor 210 may include at least one rotor blade 212. Hub rotor 220 may include seal arm 222. In various embodiments, bladed rotor assembly 200 may be an integrally bladed rotor assembly wherein the blades and the rotor are machined into a single piece of material. In various embodiments, bladed rotor assembly 200 may be a bladed rotor assembly wherein the blades and the rotor are two separate pieces of material coupled together.

In various embodiments, bladed rotor assembly 200 may undergo thermal expansion and contraction. Bladed rotor 210 may rotate and/or bend towards hub rotor 220 as illustrated by arrow 272, in response to thermal expansion. Bladed rotor 210 may rotate and/or bend towards hub rotor 220 as illustrated by arrow 272, in response to an increase in temperature.

Hub rotor 220 may rotate and/or bend towards bladed rotor 210 as illustrated by arrow 274, in response to thermal expansion. Hub rotor 220 may rotate and/or bend towards bladed rotor 210 as illustrated by arrow 274, in response to an increase in temperature. The rotation or bending of bladed rotor 210 towards hub rotor 220 and vice versa may cause compressive stress therebetween.

In various embodiments, hub interface 224 of hub rotor 220 may contact rotor interface 214 of bladed rotor 210. In various embodiments, the geometry of hub interface 224 and/or rotor interface 214 may be configured to decrease pressure between hub interface 224 and rotor interface 214. In various embodiments, the geometry of hub interface 224 and/or rotor interface 214 may be configured to decrease stress in bladed rotor 210 and/or hub rotor 220. In various embodiments, rotor interface 214 may comprise a radially inward surface. In various embodiments, hub interface 224 may comprise a radially outward surface.

With respect to FIG. 3A through FIG. 5, elements with like element numbering as depicted in FIG. 2 are intended to be the same and will not necessarily be repeated for the sake of clarity.

Figure 3A:
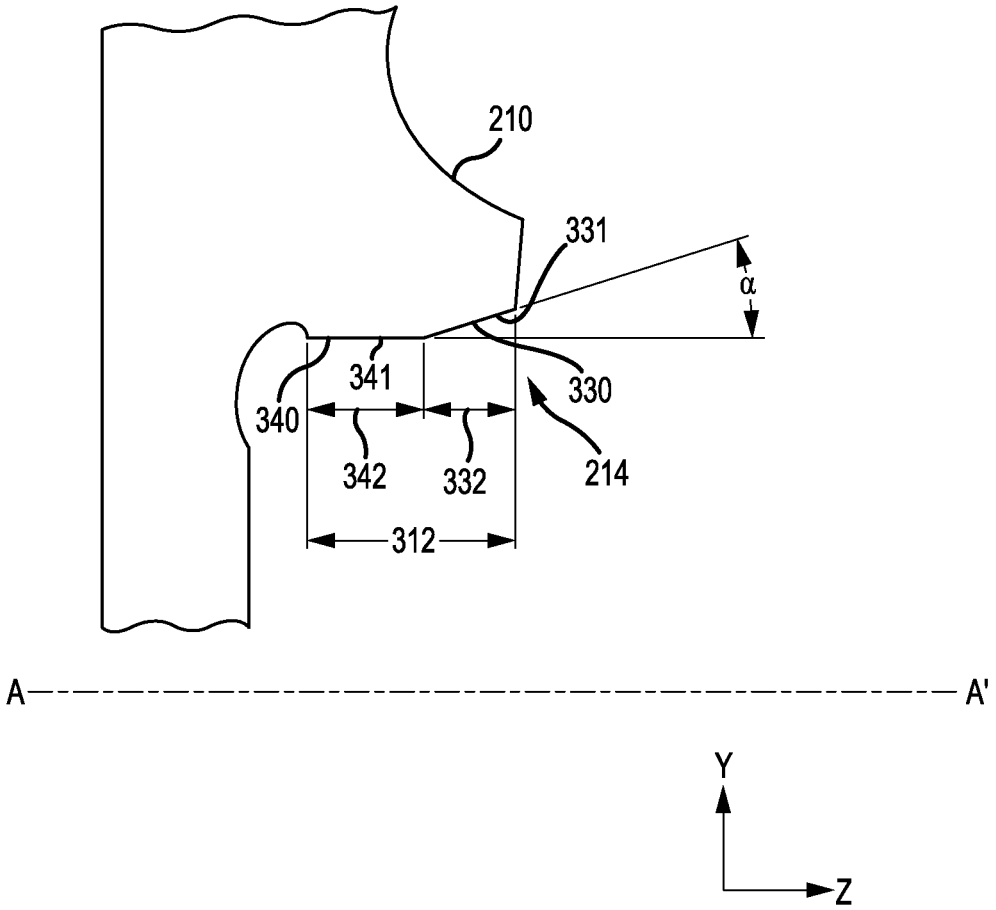
FIG. 3A illustrates a schematic view of a bladed rotor with a reduced stress zone, in accordance with various embodiments.

With reference to FIG. 3A, a bladed rotor 210 is illustrated with a reduced stress zone 330, in accordance with various embodiments. In various embodiments, rotor interface 214 may comprise a constant diameter zone 340 and a reduced stress zone 330. In various embodiments, constant diameter zone 340 may comprise an inner diameter (ID) surface 341. In various embodiments, reduced stress zone 330 may comprise an inner diameter (ID) surface 331. The ID surface 341 of constant diameter zone 340 may comprise a constant radius as measured from center axis A-A' along width 342. Reduced stress zone 330 may comprise a width 332. Constant diameter zone 340 may comprise width 342. Thus, the width 312 of rotor interface 214 may be the sum of width 342 and width 332. In various embodiments, reduced stress zone 330 may be referred to herein as a first reduced stress zone In various embodiments, width 332 may be less than width 342. In various embodiments, width 332 may be greater than width 342. In various embodiments, width 332 may be equal to width 342. In various embodiments, width 332 may be between about one percent and ninety-nine percent (1%-99%) of the width 312 of rotor interface 214, wherein the term "about" in this context only may refer to +/−1%. In various embodiments, width 332 may be between about five percent and fifty percent (5%-50%) of the width 312 of rotor interface 214, wherein the term "about" in this context only may refer to +/−5%.

In various embodiments, reduced stress zone 330 may comprise angle $\alpha$. Angle $\alpha$ may be the angle between ID surface 331 of reduced stress zone 330 and ID surface 341 of constant diameter zone 340, as illustrated in FIG. 3A. In various embodiments, angle $\alpha$ may be between one degree and eighty-nine degrees (1°-89°), between ten degrees and fifty degrees (10°-50°) in further embodiments, and between twenty-five degrees and forty-five degrees (25°-45°) in even further embodiments. In various embodiments, reduced stress zone 330 may comprise a chamfer. In various embodiments, reduced stress zone 330 may comprise a bevel. In various embodiments, reduced stress zone 330 may be located aft (in the positive z-direction) of constant diameter zone 340.

In various embodiments, reduced stress zone 330 may be configured to allow bladed rotor 210 to rotate and/or bend in the clockwise direction, as illustrated by arrow 272 of FIG. 2. In various embodiments, reduced stress zone 330 may be configured to allow hub rotor 220 to rotate and/or bend in the counter clockwise direction, as illustrated by arrow 274 of FIG. 2.

Figure 3B:
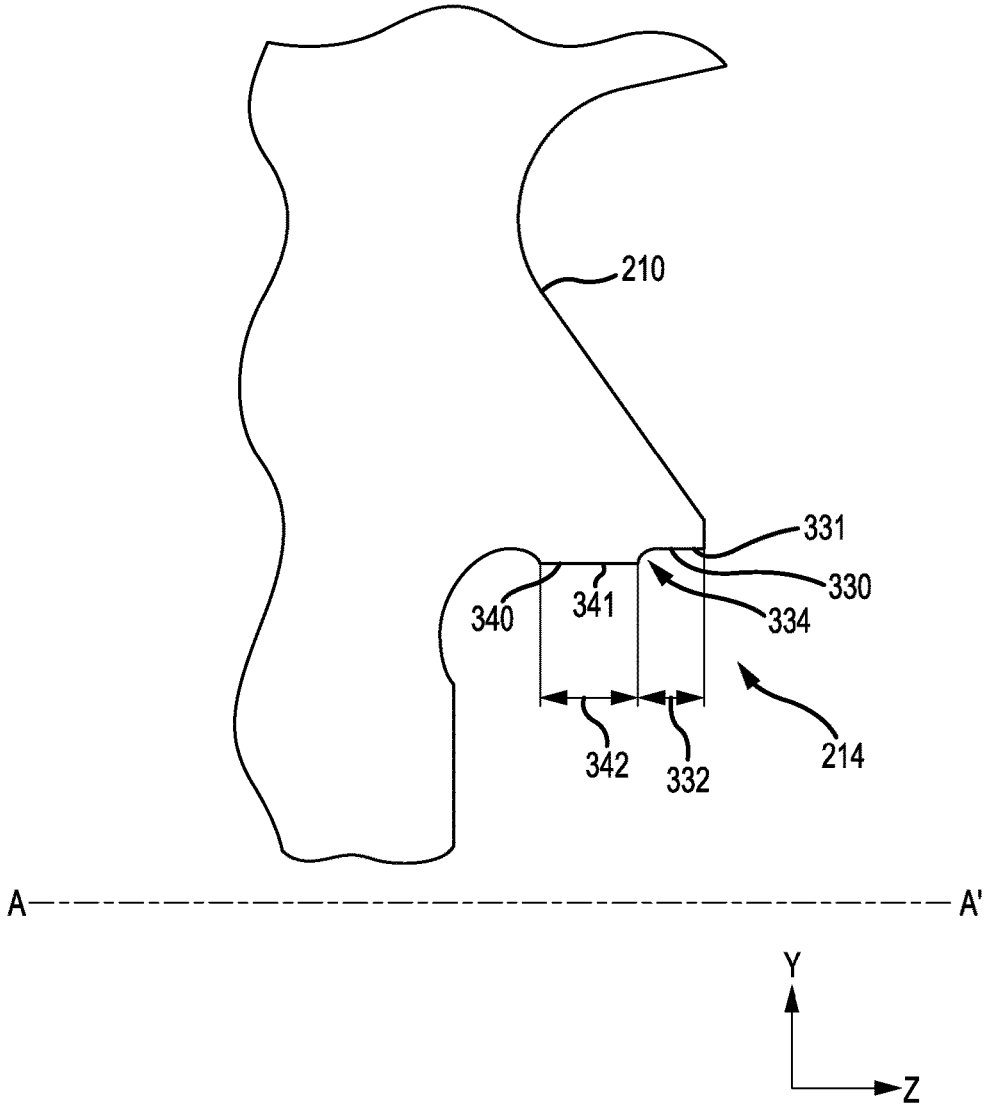
FIG. 3B illustrates a schematic view of a bladed rotor with a reduced stress zone, in accordance with various embodiments.

With reference to FIG. 3B, a bladed rotor 210 is illustrated with a reduced stress zone 330, in accordance with various embodiments. In various embodiments, ID surface 331 may comprise a diameter which is greater than the diameter of ID surface 341. In various embodiments, ID surface 331 may be parallel to ID surface 341. In various embodiments, ID surface 331 may comprise a fillet 334 located on the forward side (negative z-direction) of ID surface 331. In various embodiments, fillet 334 may be located adjacent to constant diameter zone 340. In various embodiments, fillet 334 may be replaced with an angled surface or the like.

Figure 3C:
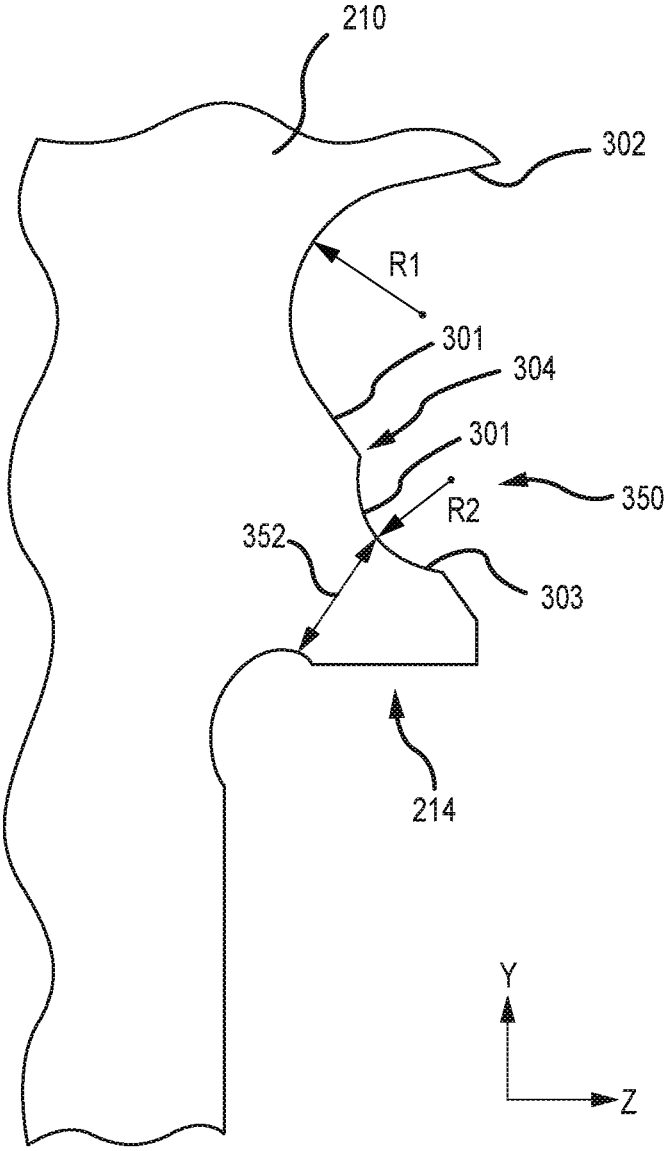
FIG. 3C illustrates a schematic view of a bladed rotor with a relief zone, in accordance with various embodiments.

With reference to FIG. 3C, a bladed rotor 210 is illustrated with a relief zone 350, in accordance with various embodiments. Relief zone 350 may be configured to mitigate compressive stress in bladed rotor 210 by allowing bladed rotor 210 to flex in response to thermal expansion and/or a force from an adjacent component. In various embodiments, relief zone 350 may comprise a concave and/or multi-curved curvilinear geometry 301 that radially overlaps with a flat surface (e.g., the radially inward surface and/or radially outward surface) and forms a narrowed neck of the bladed rotor 210. In various embodiments, relief zone 350 may be located in close proximity to rotor interface 214. In various embodiments, relief zone 350 may be located radially outward from rotor interface 214. In various embodiments, relief zone 350 may decrease a thickness 352 of bladed rotor 210. In various embodiments, the multi-curved curvilinear geometry 301 comprises a first surface 302 having a first radius $R_1$ and a second surface 303 having a second radius $R_2$, wherein the first surface 302 and the second surface 303 meet at a peak 304 defined where the first radius $R_1$ and the second radius $R_2$ intersect.

Figure 3D:
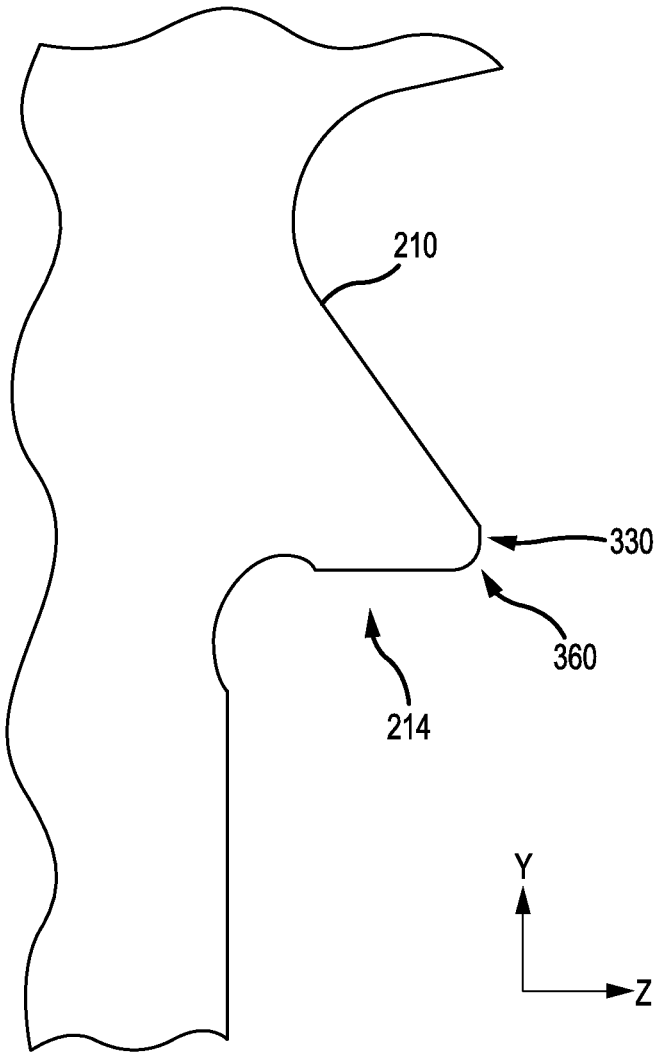
FIG. 3D illustrates a schematic view of a bladed rotor with a reduced stress zone, in accordance with various embodiments.

With reference to FIG. 3D, a bladed rotor 210 is illustrated with a reduced stress zone 330, in accordance with various embodiments. In various embodiments, the aft corner of bladed rotor 210 may comprise a rounded chamfer 360. Accordingly, reduced stress zone 330 may comprise a rounded chamfer 360. Thus, reduced stress zone 330 may be located on the aft corner of rotor interface 214.

Figure 4A:
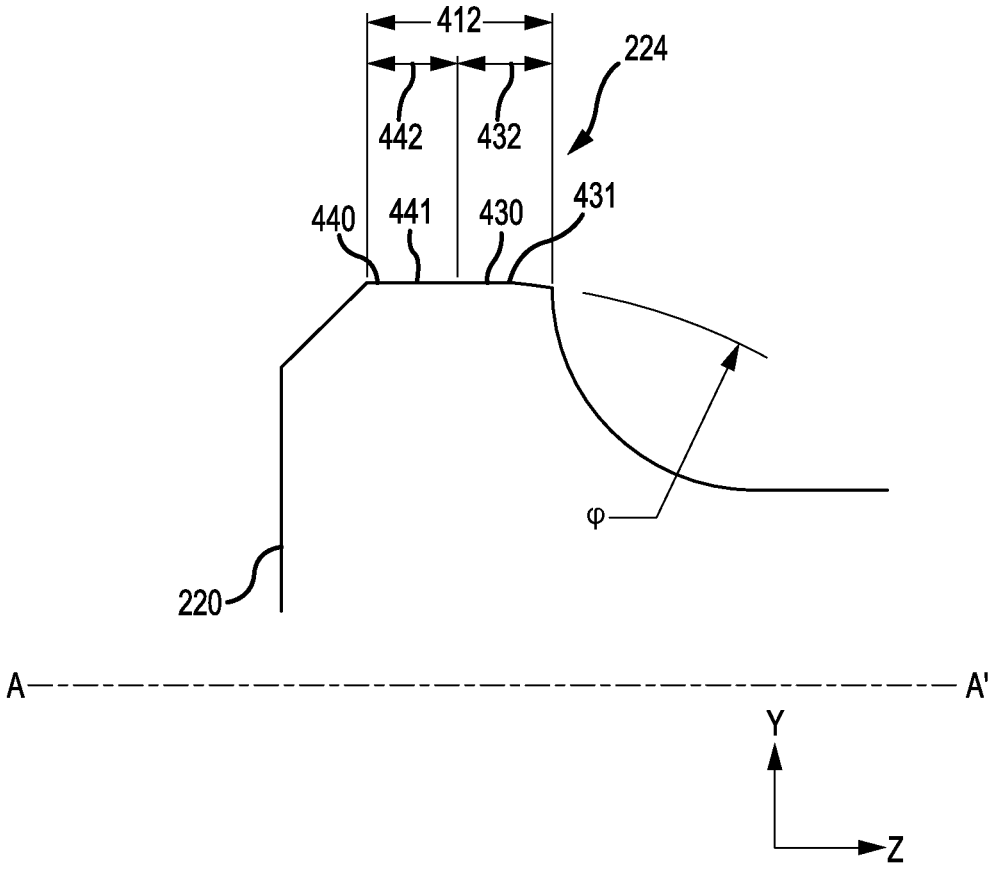
FIG. 4A illustrates a schematic view of a hub rotor with a reduced stress zone, in accordance with various embodiments.

With reference to FIG. 4A, a hub rotor 220 with a reduced stress zone 430 is illustrated, in accordance with various embodiments. In various embodiments, hub interface 224 may comprise a constant diameter zone 440 and a reduced stress zone 430. In various embodiments, constant diameter zone 440 may comprise an outer diameter (OD) surface 441. In various embodiments, reduced stress zone 430 may comprise an outer diameter (OD) surface 431. The OD surface 441 of constant diameter zone 440 may comprise a constant radius as measured from center axis A-A' along width 442. Reduced stress zone 430 may comprise a width 432. Constant diameter zone 440 may comprise width 442. Thus, the width 412 of hub interface 224 may be the sum of width 442 and width 432. In various embodiments, reduced stress zone 430 may be referred to herein as a second reduced stress zone In various embodiments, width 432 may be less than width 442. In various embodiments, width 432 may be greater than width 442. In various embodiments, width 432 may be equal to width 442. In various embodiments, width 432 may be between about one percent and ninety-nine percent (1%-99%) of the width 412 of hub interface 224, wherein the term "about" in this context only may refer to +/−1%. In various embodiments, width 432 may be between about five percent and fifty percent (5%-50%) of the width 412 of hub interface 224, wherein the term "about" in this context only may refer to +/−5%.

In various embodiments, reduced stress zone 430 may be similar to reduced stress zone 330 (see FIG. 3A). In various embodiments, OD surface 431 may comprise a rounded portion. In various embodiments, OD surface 431 may comprise a rounded portion wherein the geometry of the rounded portion is defined by a radius φ. In various embodiments, radius φ may be measured from center axis A-A'. In various embodiments, radius φ may be measured from a location around which hub rotor 220 generally rotates and/or bends. However, radius φ may be measured from any suitable location.

With reference to FIG. 4B, a hub rotor 220 is illustrated with a reduced stress zone 430, in accordance with various embodiments. In various embodiments, OD surface 431 may comprise a diameter which is less than the diameter of OD surface 441. In various embodiments, OD surface 431 may be parallel to OD surface 441. In various embodiments, OD surface 431 may comprise a fillet 434 located on the forward side (negative z-direction) of OD surface 431. In various embodiments, fillet 434 may be located adjacent to constant diameter zone 440. In various embodiments, fillet 434 may be replaced with an angled surface or the like.

With reference to FIG. 4C, a hub rotor 220 is illustrated with a relief zone 450, in accordance with various embodiments. Relief zone 450 may be configured to mitigate compressive stress in hub rotor 220 by allowing hub rotor 220 to flex in response to thermal expansion and/or a force from an adjacent component. In various embodiments, relief zone 450 may comprise a concave geometry. In various embodiments, relief zone 450 may comprise a concave surface, slot, pocket, extrude cut, trench, or the like. In various embodiments, relief zone 450 may be located in close proximity to hub interface 224. In various embodiments, relief zone 450 may be located radially inward from hub interface 224. In various embodiments, relief zone 450 may decrease a thickness 452 of hub rotor 220. In various embodiments, relief zone 450 may comprise a depth 454. In various embodiments, depth 454 may comprise between about one percent and fifty-five percent (1%-55%) of the width 412 of hub interface 224, wherein the term "about" in this context only refers to +/−5%.

Figure 4D:
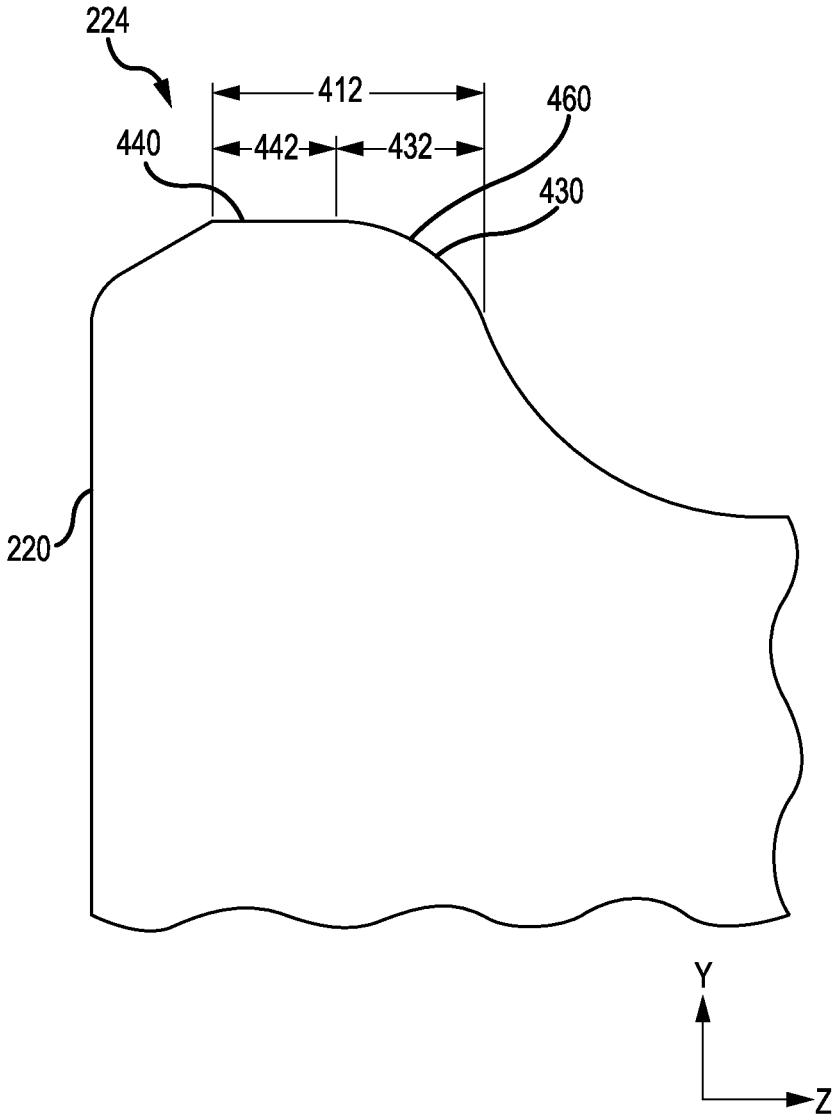
FIG. 4D illustrates a schematic view of a hub rotor with a reduced stress zone, in accordance with various embodiments.

With reference to FIG. 4D, a hub rotor 220 with a reduced stress zone 430 is illustrated, in accordance with various embodiments. In various embodiments, the aft corner of hub rotor 220 may comprise a rounded chamfer 460. Accordingly, reduced stress zone 430 may comprise a rounded chamfer 460. Thus, reduced stress zone 430 may be located on the aft corner of rotor interface 214.

With reference to FIG. 4E, a hub rotor 220 is illustrated with a reduced stress zone 430, in accordance with various embodiments. In various embodiments, reduced stress zone 430 may comprise angle Θ. Angle Θ may be the angle between OD surface 431 of reduced stress zone 430 and OD surface 441 of constant diameter zone 440, as illustrated in FIG. 3A. In various embodiments, angle Θ may be between one degree and eighty-nine degrees (1°-89°), between ten degrees and fifty degrees (10°-50°) in further embodiments, and between twenty-five degrees and forty-five degrees (25®-45°) in even further embodiments. In various embodiments, reduced stress zone 430 may comprise a chamfer. In various embodiments, reduced stress zone 430 may comprise a bevel. In various embodiments, reduced stress zone 430 may be located aft (in the positive z-direction) of constant diameter zone 440.

Figure 5:
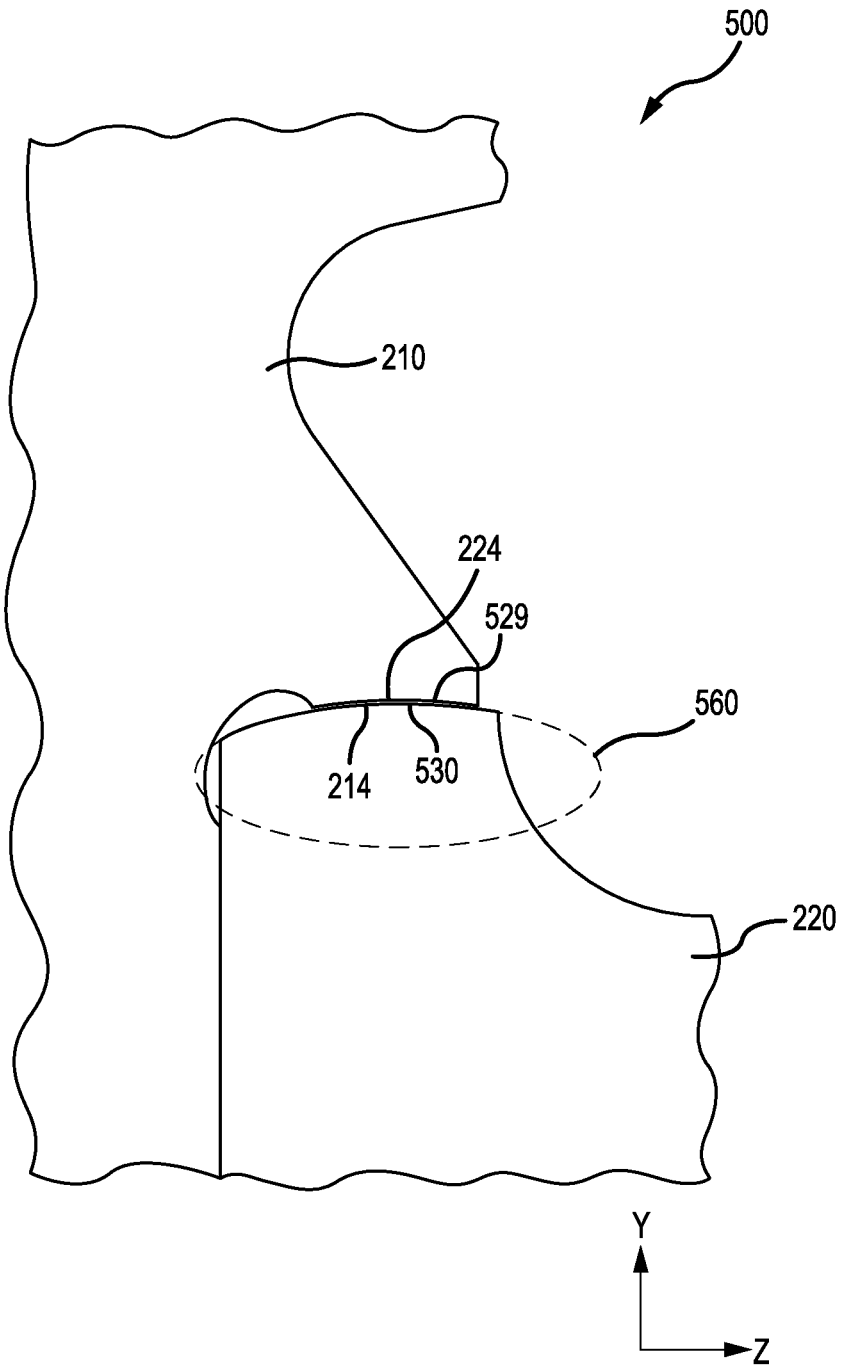
FIG. 5 illustrates a schematic view of a bladed rotor assembly with a rotor interface comprising a first reduced stress zone and a hub interface comprising a second reduced stress zone, in accordance with various embodiments.

With reference to FIG. 5, a bladed rotor assembly 500 is illustrated, in accordance with various embodiments. In various embodiments, bladed rotor assembly 500 may be similar to bladed rotor assembly 200 (see FIG. 2). In various embodiments, rotor interface 214 may comprise reduced stress zone 530. In various embodiments, hub interface 224 may comprise reduced stress zone 529. In various embodiments, rotor interface 214 may comprise a concave surface as illustrated in FIG. 5. In various embodiments, hub interface 224 may comprise a convex surface as illustrated in FIG. 5. The geometry of rotor interface 214 may be complementary to the geometry of hub interface 224. In various embodiments, imaginary line 560 may define an oval which may partially define the geometry of reduced stress zone 529 and reduced stress zone 530.

Although illustrated as rotor interface 214 comprising a concave surface and hub interface 224 comprising a convex surface, it should be understood that rotor interface 214 may comprise a convex surface and hub interface 224 may comprise a concave surface.

In various embodiments, the geometry of hub interface 224 and of rotor interface 214 may be configured to provide a sliding surface over which bladed rotor 210 and hub rotor 220 may slide with respect to one another. In various embodiments, the geometry of hub interface 224 and of rotor interface 214 may be configured to provide a rotating surface over which bladed rotor 210 and hub rotor 220 may rotate with respect to one another.

With reference to FIG. 3A through FIG. 5, the reduced stress zones and the relief zones as described herein may be used interchangeably as well as in combination, in accordance with various embodiments. Furthermore, any reduced stress zone and/or relief zone as described in relation to a bladed rotor 210 may be implemented in a hub rotor 220 and vice versa, in accordance with various embodiments.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A bladed rotor for a gas turbine engine, the gas turbine engine comprising a center axis extending from forward to aft, wherein the bladed rotor comprises:

a rotor interface configured to engage an interface of a hub rotor disposed aft of the bladed rotor, the rotor interface comprising a radially inward surface, wherein a diameter extending between the center axis of the gas turbine engine and the radially inward surface along an axial span of the rotor interface is constant; and a relief zone comprising a multi-curved curvilinear geometry radially overlapping with the radially inward surface and located radially outward of the radially inward surface to decrease a thickness of the bladed rotor and form a narrowed neck of the bladed rotor at the multi-curved curvilinear geometry, the multi-curved curvilinear geometry comprising a first surface having a first radius and a second surface having a second radius, wherein the first surface and the second surface meet at a peak defined where the first radius and the second radius intersect;

wherein the rotor interface and the interface of the hub rotor are configured to provide a sliding surface over which the bladed rotor and the hub rotor at least one of slide or rotate with respect to one another.

2. The bladed rotor of claim 1, wherein an axial dimension of the axial span is between about 1% and 99% of an axial width of the rotor interface.

3. The bladed rotor of claim 1, wherein an axial dimension of the axial span is between about 5% and 50% of an axial width of the rotor interface.

4. A hub rotor for a gas turbine engine, the gas turbine engine comprising a center axis extending from forward to aft, wherein the hub rotor comprises:

a hub interface configured to engage an interface of a bladed rotor disposed forward of the hub rotor, the hub interface comprising a radially outward surface; and a relief zone comprising at least one of a multi-curved curvilinear surface radially overlapping with the radially outward surface and creating a peak at an intersection of a first surface having a first radius and a second surface having a second radius wherein the first surface and the second surface meet at the peak, a slot, a pocket, an extrude cut, and a trench located radially inward of the radially outward surface to decrease a thickness of the bladed rotor and form a narrowed neck of the bladed rotor;

wherein the hub interface and the interface of the bladed rotor are configured to provide a sliding surface over which the hub rotor and the bladed rotor at least one of slide or rotate with respect to one another.

5. The hub rotor of claim 4, wherein an axial dimension of the relief zone is between about 1% and 55% of an axial width of the hub interface.

6. A bladed rotor assembly for a gas turbine engine, comprising:

a bladed rotor comprising a rotor interface comprising a radially inward surface and a first relief zone having a multi-curved curvilinear geometry radially overlapping with the radially inward surface and located radially outward of the radially inward surface to decrease a thickness of the bladed rotor and form a narrowed neck of the bladed rotor at the multi-curved curvilinear geometry, the multi-curved curvilinear geometry comprising a first surface having a first radius and a second surface having a second radius, wherein the first surface and the second surface meet at a peak defined where the first radius and the second radius intersect; and a hub rotor comprising a hub interface comprising a radially outward surface and a second relief zone having at least one of the multi-curved curvilinear surface, a slot, a pocket, an extrude cut, and a trench located radially inward of the radially outward surface to decrease a thickness of the bladed rotor and form a narrowed neck of the bladed rotor;

wherein the rotor interface and the hub interface are configured to provide a sliding surface over which the bladed rotor and the hub rotor at least one of slide or rotate with respect to one another.

7. The bladed rotor assembly of claim 6, wherein the radially inward surface further comprises a constant diameter zone, wherein a diameter along a width of the constant diameter zone is constant.

* * * * *